US005829399A

United States Patent [19]

Scheidt et al.

[11] Patent Number: 5,829,399

[45] Date of Patent: Nov. 3, 1998

[54] PRESSURE FLUID SUPPLY SYSTEM FOR A VARIABLE CAMSHAFT ADJUSTMENT

[75] Inventors: Martin Scheidt, Adelsdorf; Dieter Goppelt, Aurachtal; Manfred Wilhelm; Eduard Golovatai-Schmidt, both of Röttenbach, all of Germany

[73] Assignee: Ina Wälzlager Schaeffler oHG, Herzogenaurach, Germany

[21] Appl. No.: 763,409

[22] Filed: Dec. 11, 1996

[30] Foreign Application Priority Data

Dec. 15, 1995 [DE] Germany ..... 195 46 935.6
Apr. 17, 1996 [DE] Germany ..... 196 15 076.0

[51] Int. Cl.[6] ..... F01L 1/344

[52] U.S. Cl. ..... 123/90.17; 123/90.31

[58] Field of Search ..... 123/90.15, 90.17, 123/90.31

[56] References Cited

U.S. PATENT DOCUMENTS 5,012,774 5/1991 Strauber et al. ..... 123/90.17
5,088,456 2/1992 Suga ..... 123/90.17
5,150,671 9/1992 Suga ..... 123/90.17
5,201,289 4/1993 Imai ..... 123/90.17
5,540,197 7/1996 Golovatai-Schmidt et al. .... 123/90.17
5,566,651 10/1996 Strauss et al. ..... 123/90.17

*Primary Examiner*—Weilun Lo
*Attorney, Agent, or Firm*—Henry M. Feiereisen

[57] ABSTRACT

Apparatus for adjusting a rotational relation between a camshaft and a timing pulley of an internal combustion engine of a type having a crankshaft for driving the timing pulley and a cylinder head for rotatably supporting the camshaft, includes a housing receiving a double-acting piston for displacement in an axial direction between two axially spaced end positions and defining with the housing two pressure compartments. Secured to the piston is a control bushing which is geared to the timing pulley via a first gearing and operatively connected to the camshaft via a second gearing. A hydraulic regulating unit is fluidly connected to the pressure compartments via fluid-carrying passageways for alternately supplying a pressure fluid to the pressure compartments to effect an axial displacement of the piston and thereby a positional adjustment of the control bushing, with the fluid-carrying passageways including, for movement of the piston into one of the end positions, two axially spaced distribution spaces which are fluidly connected to each other by transition zones arranged in angularly offset disposition.

12 Claims, 4 Drawing Sheets

PRESSURE FLUID SUPPLY SYSTEM FOR A VARIABLE CAMSHAFT ADJUSTMENT

BACKGROUND OF THE INVENTION

The present invention refers to an apparatus for adjusting a rotational relation between a camshaft and a timing pulley of an internal combustion engine of a type being controlled by gas exchange valves and having a crankshaft for driving the timing pulley and a cylinder head for rotatably supporting the camshaft.

U.S. Pat. No. 5,080,052 discloses a variable valve timing system in an internal combustion engine for adjusting the control times of the gas exchange valves to effect an operation over a wide speed range, i.e. for improving the torque characteristic, exhaust emission and fuel consumption. This variable timing system includes a spring-biased piston which is received in a housing to define a pressure compartment. A timing pulley is rotatably supported on the camshaft and meshes with a timing belt by which the driving force of the engine is transmitted to the timing pulley and thus to the camshaft to operate intake and/or exhaust valves. Upon increase of the revolution speed of the engine, a control valve is activated to permit hydraulic fluid under pressure to flow to the pressure compartment. Thus, the piston is shifted in opposition to the spring to thereby change the angular rotational relation between the timing pulley and the camshaft and thus the valve timing of the intake and/or exhaust valves. When running condition permit a switch-over of the control valve, e.g. upon stoppage of the internal combustion engine, hydraulic fluid is permitted to flow unhindered via an internal conduit back from the pressure compartment to a pressure fluid pan. As a consequence, the piston looses its hydraulic prestress so that the piston is unable to retain its starting position when restarting the internal combustion engine. This shift of the piston results in a disadvantageous change of the valve timing of the gas exchange valves and thus adversely affects the start of the internal combustion engine and the exhaust emission. Moreover, the uncontrolled shift of the piston causes an impact on an end stop which leads to noise development and increased wear.

German Pat. No. 33 16 162 describes an apparatus for automatic variation of the position of a camshaft relative to the crankshaft, which includes a piston that is fixed in place upon stoppage of the engine by a suitably dimensioned counterspring that exerts a high spring force. Even though the piston retains its starting position, the required increased buildup of oil pressure to overcome the force of the counterspring when starting the engine is undesired. Moreover, this system causes a disadvantageous time delay with respect to the operation of the adjusting mechanism.

SUMMARY OF THE INVENTION

It is an object of the present invention to provide an improved apparatus for adjusting a rotational relation between a camshaft and a timing pulley of an internal combustion engine, obviating the afore-stated drawbacks.

In particular, it is an object of the present invention to provide an improved apparatus for adjusting a rotational relation between a camshaft and a timing pulley of an internal combustion engine, which improves the starting behavior of the engine and ensures a rapid operation of the adjusting mechanism.

These objects and others which will become apparent hereinafter are attained in accordance with the present invention by providing a double-acting piston reciprocating within a housing between two axially spaced end positions and defining two pressure compartments which are fluidly sealed from one another, and by so fluidly conducting pressure fluid to the pressure compartments to act upon the piston that, for movement of the piston in one of the end positions representing the starting position, the pressure fluid is conducted via axially spaced distribution spaces in form of annular grooves which are fluidly connected to each other by transition zones arranged in angularly offset disposition.

The provision of such distribution spaces results in an advantageous labyrinth-like pressure fluid conduction by which a backflow of fluid from the pressure compartments to the reservoir is effectively eliminated. The pressure compartment which is acted upon by hydraulic fluid to shift the piston into the starting position remains filled with fluid, thereby biasing the piston to retain in place. As a result, the starting behavior of the engine is enhanced and any generation of annoying and wear-promoting noise caused by changing torque of the camshaft and high-frequency impacting on end stops is prevented. In order to even further eliminate a possibility of a backflow of pressure fluid, non-return valves may be incorporated in the respective passageways. The nearly complete filling of the pressure compartments further results in a more rapid pressure fluid buildup and thus improved operativeness of the apparatus. This is especially true when applying the apparatus according to the invention with a camshaft to operate exhaust gas exchange valves because a change of the basic position in the starting phase requires the pressure fluid to carry out an adjustment against the camshaft friction thereby delaying the operativeness.

The apparatus according to the present invention also optimizes the exhaust emission for which variable valve timing systems are primarily intended for.

Through the provision of axially spaced annular grooves that are fluidly connected by angularly offset transition zones, pressure fluid is prevented from escaping the pressure compartments and a minimum filling level is kept within the pressure compartments as a result of the retained pressure fluid. The innovative and novel pressure fluid conduction in conjunction with an effective sealing of the pressure compartments from one another, also prevents an undesired penetration of air into the pressure compartment because air can migrate only via the pressure fluid conduction. Thus, the pressure compartment remains fully filled so long as the underpressure generated by outflowing pressure fluid is insufficient to aspirate air. This effect is effectively prevented by the maze-like pressure fluid conduction.

Preferably, the annular grooves are formed in hollow-cylindrical components of the apparatus, such as e.g. a hub, a sleeve-like seal carrier that is mounted on the camshaft, a guide bush having one end received fluid-tight by the seal carrier, or a toothed sleeve that is mounted on the camshaft, with the transition zones being formed by bores in relative angular offset disposition. These annular grooves of rotationally symmetrical configuration are easy to make and prevent an undesired outflow of pressure fluid from the pressure compartments. Suitably, the annular grooves are formed in the inner wall surface of the respective component at the end faces or axially offset to the end face.

According to another feature of the present invention, the transition zones between the annular grooves are offset by 120°, with one transition zone always coinciding with a vertical axis of the apparatus in the assembled state. In this manner, a further safety mechanism is provided to prevent an escape of pressure fluid from the pressure compartments. If need be, each of the transition zones may also be formed by several neighboring bores.

According to still another feature of the present invention, a sealing ring is secured on the guide bush and exhibits a sealing lip bearing upon an inside surface of the control bushing which is in concentric disposition to the guide bush for further effectively sealing the pressure compartments from one another. This sealing ring prevents a pressure fluid exchange between the pressure compartments.

In order to ensure an offset disposition by 120° between the transition zones, the seal carrier is secured in place relative to the guide bush by an anti-rotation device- that allows assembly of these components only a particular angular position to ensure the labyrinth-like pressure fluid conduction between the seal carrier and the guide bush. Preferably, the anti-rotation device is formed by a ring which is securely mounted on the toothed sleeve and exhibits on the cylinder head facing side an axial protusion for engagement in a bore of the seal carrier. Thus, the guide bush and the seal carrier can be assembled only in a particular angular position to effect the intended offset disposition of the transition zones by which an automatic backflow of pressure fluid to a lubricating oil pan is eliminated during stoppage of the engine. The anti-rotation device effects a form-fitting connection that is accomplished only after assembly of the adjustment apparatus according to the present invention. This type of anti-rotation device is easy to make in a cost-efficient manner and can be incorporated in the given installation space of the apparatus. Suitably the ring is formed through a deep-drawing process in non-cutting manner.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
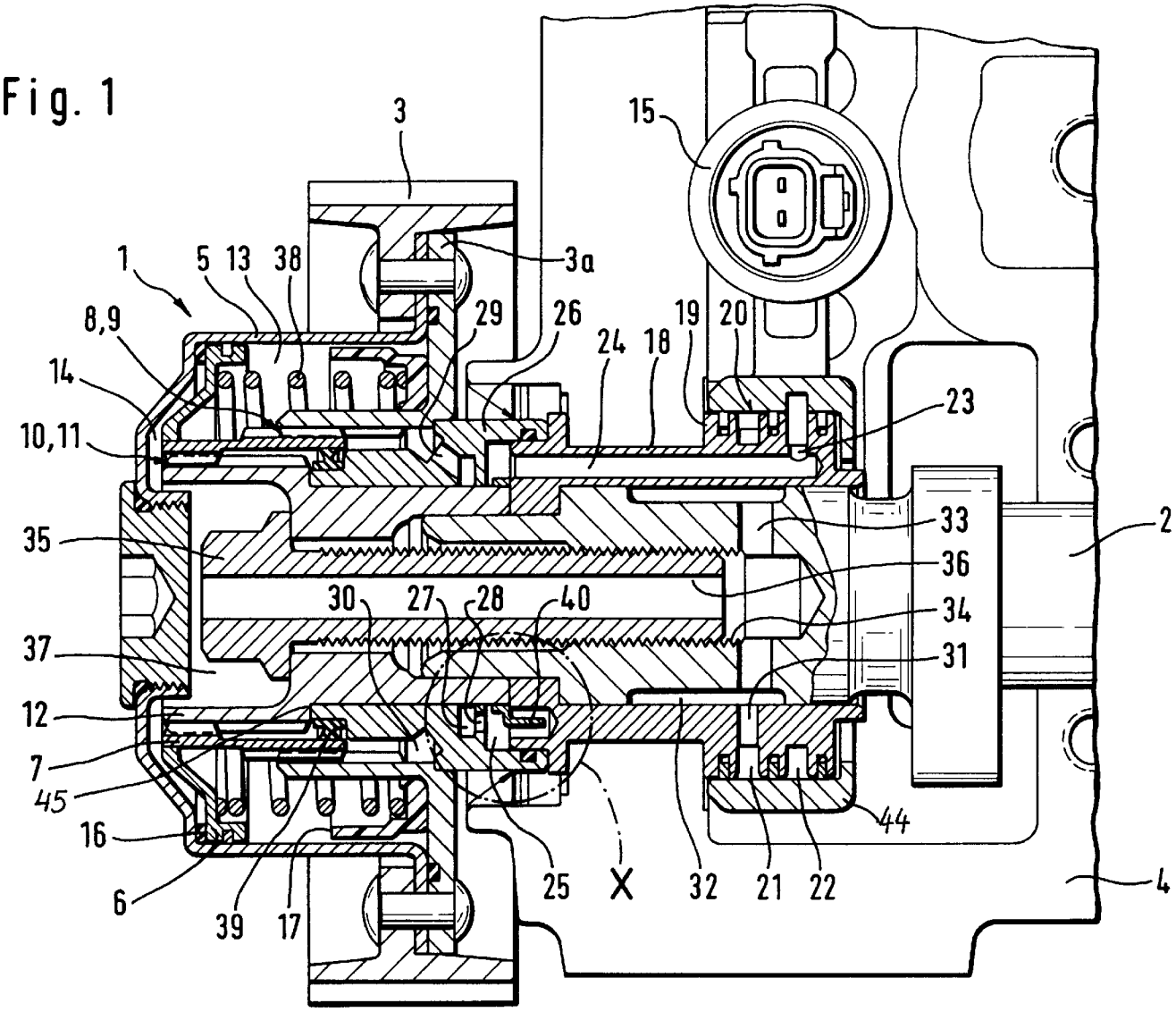
FIG. 1 is a longitudinal section of one embodiment of a variable camshaft adjustment apparatus according to the present invention, installed in the cylinder head.

Throughout all the Figures, the same or corresponding elements are always indicated by the same reference numerals.

Figure 2:
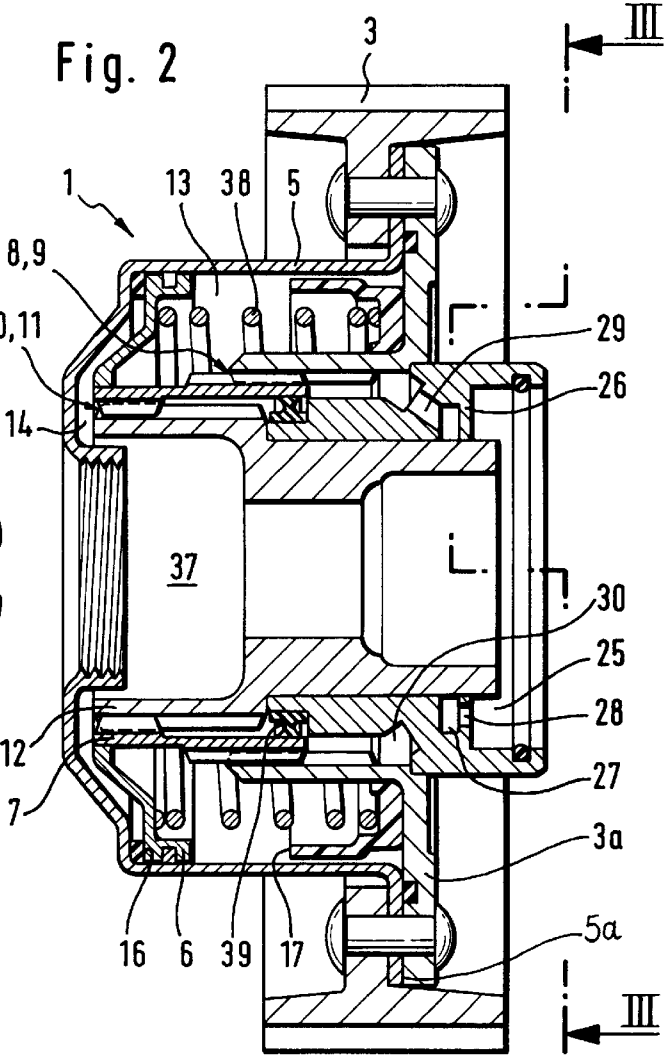
FIG. 2 is a longitudinal section of the variable camshaft adjustment apparatus separated from the cylinder head.

Turning now to the drawing, and in particular to FIGS. 1 and 2, there are shown respective longitudinal sections of a variable camshaft adjustment apparatus according to the present invention, generally designated by reference numeral 1 for adjusting a rotational relation between a camshaft 2 and a timing pulley 3 of an internal combustion engine and thereby adjust the valve timing of gas exchange valves (not shown). The camshaft 2 is rotatably supported in a cylinder head 4, with the camshaft adjustment apparatus 1 being arranged in driving relationship between the camshaft 2 and the timing pulley 3. A timing belt (not shown) is in mesh with the timing pulley 3 to transmit the driving force of the engine via a crankshaft (not shown) to the timing pulley 3 and thus to the camshaft 2 in order to operate the gas exchange valves.

The timing pulley 3 is formed integrally with a flange portion 3*a* of L-shaped configuration and concentrically circumscribes a housing 5 which is formed with a flange portion 5*a* secured to the timing pulley 3. Received within the housing 5 for axial displacement is an adjusting piston 6 which defines with the housing 5 two pressure compartments 13, 14. The piston 6 is connected to a hollow-cylindrical control bushing 7 which has an outer helical gear 8 in mesh with an inner helical gear 9 of the flange portion 3*a* of the timing pulley 3, and with an inner helical gear 10 in mesh with an outer helical gear 11 of a toothed sleeve 12 which is securely fixed to the cylinder head distant end of the camshaft 2 to extend the camshaft 2 in axial direction. Upon transmission of a driving force of the engine to the timing pulley 3 via the timing belt, the timing pulley 3 is rotated. The rotation of the timing pulley 3 is transmitted to the control bushing 7 which thus is shifted in axial direction to trigger a relative rotation between the timing pulley 3 and the camshaft 2.

The pressure compartments 13, 14 within the housing 5 are alternately acted upon by a pressure fluid to effect an axial displacement of the piston 6 and thus of the control bushing 7. Lubricating oil of a pressure circulation lubrication of the internal combustion engine is used as pressure fluid for supply to the pressure compartments 13, 14.

The end region of the camshaft 2 facing the piston 6 is encompassed by a connecting bracket 44 which is mounted in the cylinder head 4 and includes a control valve 15 for supply of pressure fluid. The control valve 15 regulates a flow of pressure fluid through an oil inlet (not shown) and an oil outlet (not shown) via which, especially in response to the revolution speed, pressure fluid is supplied to one of the pressure compartments 13, 14 for infinitely variable adjustment of the piston 6 between two end positions as defined by an end stop 16 secured to the inside wall surface of the housing 5 and an end stop 17 secured to the flange portion 3*a* of the timing pulley 3.

Figure 4:
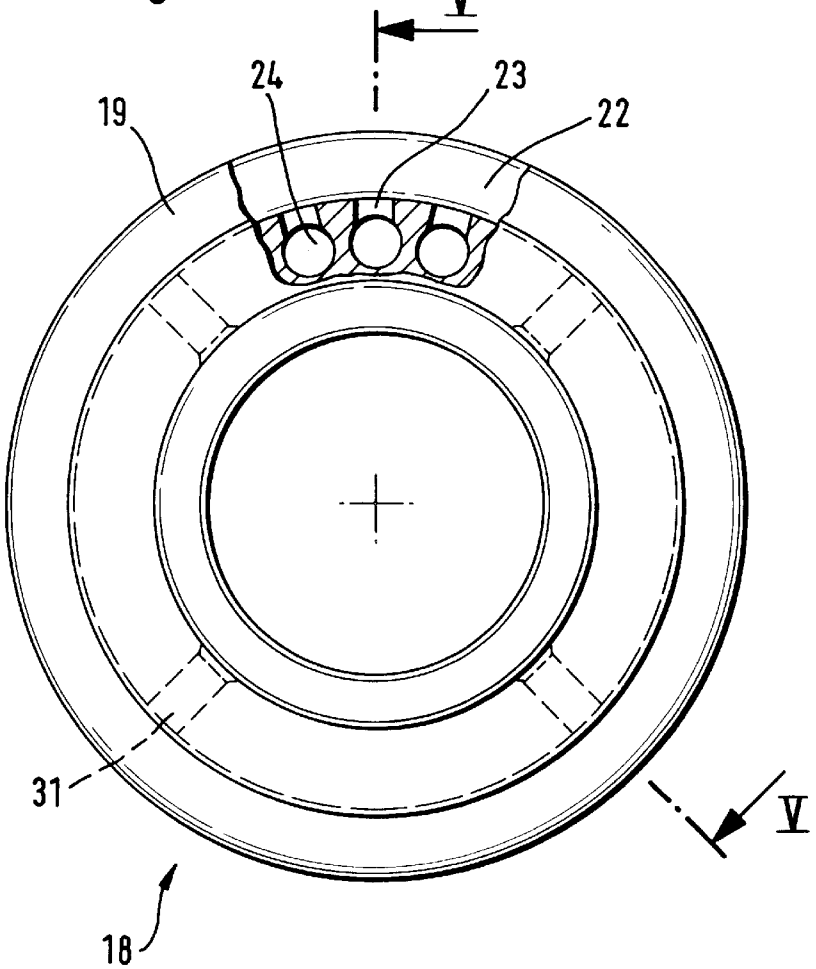
FIG. 4 is a partially sectional front view of a seal carrier, as shown in FIG. 1.
Figure 5:
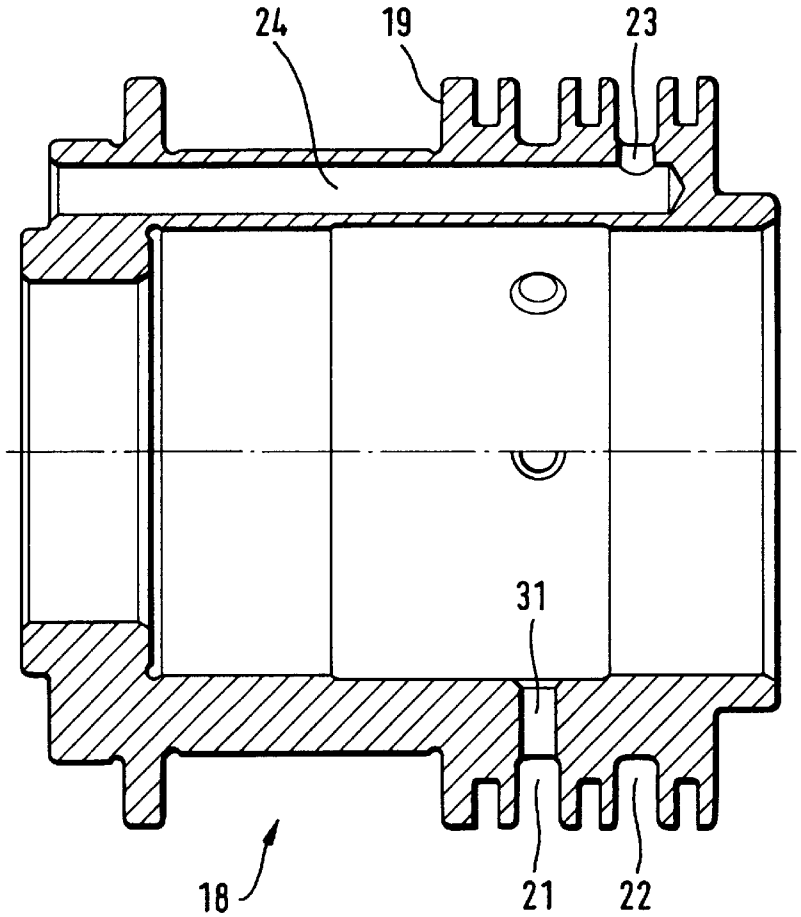
FIG. 5 is a sectional view of the seal carrier, taken along the line V—V in FIG. 4.

Pressure fluid is conducted between the control valve 15 and the pressure compartment 13 via a seal carrier 18 which is shaped of sleeve-like configuration, as shown in particular in FIGS. 4 and 5, and placed over the end region of the camshaft 2. At its end distant to the camshaft adjustment apparatus 1, the seal carrier 18 is formed with a cylindrical extension 19 which is fitted in fluid-tight fashion in a receiving bore 20 of the cylinder head 4. The extension 19 is formed with circumferential grooves 21, 22 which are in fluid communication with the control valve 15 via bores (not shown) in the cylinder head 4. The circumferential groove 22 is fluidly connected via a radial bore 23 with an axial bore 24 formed within the seal carrier 18. The bore 24 terminates in a ring channel 25 which is formed at the end face of the seal carrier 18 between the seal carrier 18 and a guide bush 26. Persons skilled in the art will understand that the fluid connection between the radial bore 23 and the ring channel 25 can be expanded by forming three axial bores 24, as shown in FIG. 4 which is a partially sectional front view of the rotationally symmetrical seal carrier 18.

The guide bush 26 circumscribes the toothed sleeve 12 and has one end which bears upon a shoulder 45 of the toothed sleeve 12 and another end fitted in fluid-tight manner on the seal carrier 18.

Spaced axially from the ring channel 25 is a further ring channel 27 which is fluidly connected to the ring channel 25 by a transfer zone 28. In addition, the ring channel 27 is fluidly connected by a transfer zone 29 to a distribution space 30 which is formed between the guide bush 26 and the gearing 8, 9 between the control bushing 7 and the flange portion 3*a* and is in fluid communication with the pressure compartment 13 via the gearing 8, 9. In order to ensure an unhindered flow of pressure fluid from the distribution space 30 to the pressure compartment 13, one tooth of the gearing 8, 9 is removed.

Supply of pressure fluid to the pressure compartment 14 is effected from the control valve 15 via the circumferential bore 21 and a radial bore 31 in the seal carrier 18 (FIG. 5). The radial bore 31 is axially offset with respect to the radial bore 23 and is fluidly connected to a wide, circumferential recess 32 which is formed in the camshaft 2 and extends in axial direction. As shown in FIG. 4, it is preferred to form four radial bores 31 which are spaced about the circumference of the seal carrier 18 for fluid conduction to the pressure compartment 14.

The recess 32 is fluidly connected via bores 33 to a threaded bore 34 which is formed centrally in the end region of the camshaft 2. Received in the threaded bore 34 is a screw 35 to securely retain the toothed sleeve 12 and the seal carrier 18 with the camshaft 2. At its camshaft-distal end, the toothed sleeve 12 is formed with a recess 37 for receiving the head portion of the screw 35. The screw 35 is formed with an axial bore 36 to provide a fluid communication to the recess 37 which directly communicates with the pressure compartment 14 that is disposed concentric to the recess 37.

Figure 3:
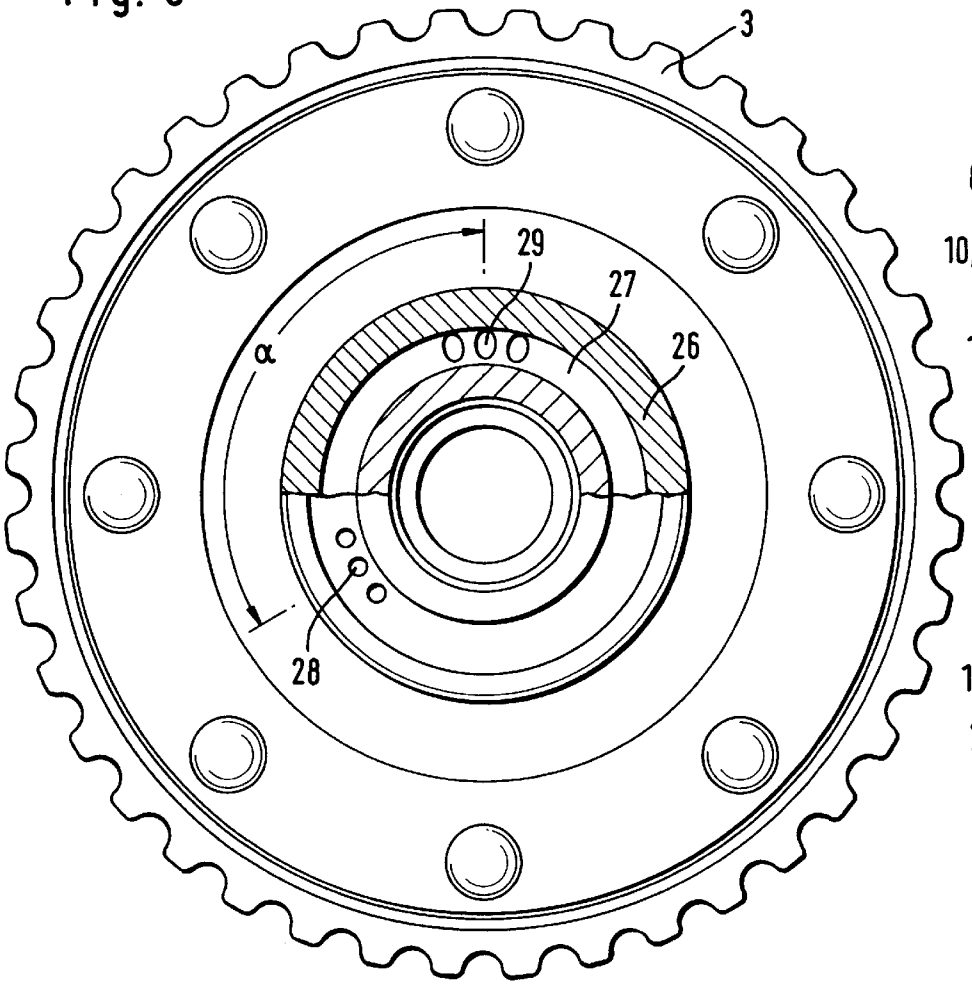
FIG. 3 is a partially sectional front view of the variable camshaft adjustment apparatus, taken along the line III—III in FIG. 2.

Turning now to FIG. 3, there is shown a partially sectional front view of the variable camshaft adjustment apparatus 1, taken along the line III—III in FIG. 2. As can be seen from FIG. 3 in conjunction with FIG. 2, the transfer zones 28, 29 for fluidly connecting the ring channels 25, 27 and the distribution space 30 are arranged in offset angular disposition for preventing an emptying of the pressure compartment 13, i.e. a pressure fluid flow back to the lubricant pan during stoppage of the engine. This ensures a hydraulic prestress of the piston 6 and secures the piston 6 in place against the end stop 16 also in the starting phase of the engine. Suitably, a compression spring 38 is disposed between the piston 6 and the end stop 17 to so load the piston 6 as to seek the starting position. In order to prevent a fluid communication between the pressure compartments 13, 14, a sealing ring 39 is mounted on the guide bush 26. The sealing ring 39 is formed with a sealing lip which bears against an inside wall surface of the control bushing 7 to thereby seal the pressure compartment 13 from the pressure compartment 14.

Figure 6:
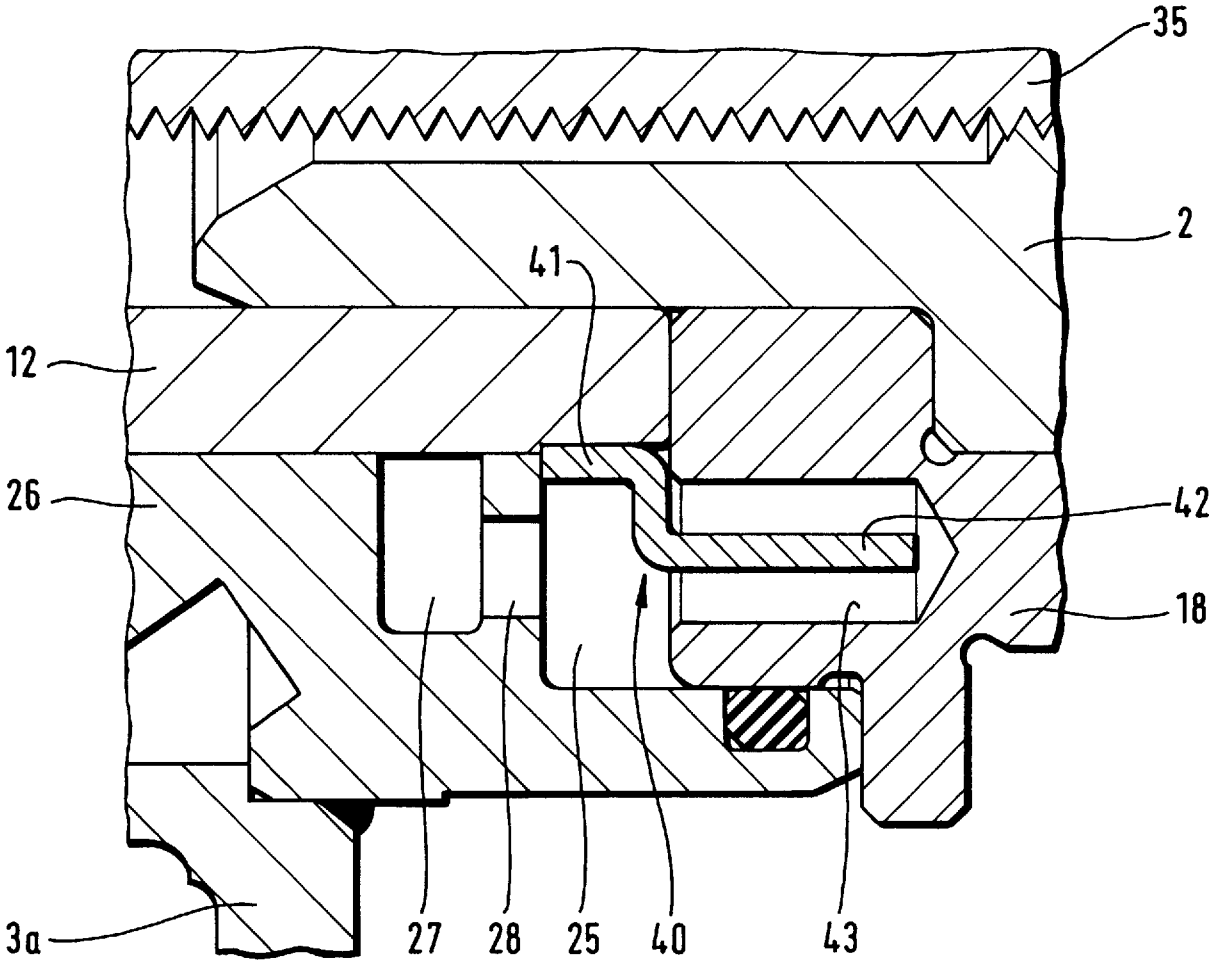
FIG. 6 is a cutaway view, on an enlarged scale, of a detail marked "X" in FIG. 1.

Preferably, the transfer zones 28, 29 are angularly offset from one another at an angle $\alpha$ of 120°, whereby one of the transfer zones 28, 29 (here transfer zone 29) extends in a vertical axis. The transfer zones 28, 29 may be formed by a single bore, or, as shown in FIG. 3, may each be formed by three neighboring bores to enlarge the opening cross section. In order to ensure the intended offset angular disposition of the transfer zones 28, 29 in the assembled state, an anti-rotation device 40 is provided between the seal carrier 18 and the guide bush 26, as will now be described with reference to FIG. 6.

The anti-rotation device 40 includes a ring 41 which is securely fixed to the toothed sleeve 12 so as to be prevented from carrying out any rotation relative thereto. The ring 41 is preferably made through a non-cutting deep-drawing process and is formed with a protusion 42 to exhibit a generally Z-shaped configuration. Upon assembly of the apparatus 1, the protusion 42 extends in axial direction toward the camshaft 2 and is engageable in form-fitting fashion in a bore 43 of the seal carrier 18. As a consequence, the guide bush 26 and the seal carrier 18 can be positioned relative to each other only in a particular disposition to thereby effect the intended offset angular position between the transfer zones 28, 29.

While the invention has been illustrated and described as embodied in a pressure fluid supply system for a variable camshaft adjustment, it is not intended to be limited to the details shown since various modifications and structural changes may be made without departing in any way from the spirit of the present invention.

What is claimed as new and desired to be protected by Letters Patent is set forth in the appended claims:

1. Apparatus for adjusting a rotational relation between a camshaft and a timing pulley of an internal combustion engine of a type having a crankshaft for driving the timing pulley and a cylinder head for rotatably supporting the camshaft, said apparatus comprising:

a housing;

a double-acting piston reciprocating within the housing between a starting position and a working position and defining two pressure compartments which are fluidly sealed from one another;

a control bushing secured to the piston and geared to the timing pulley via a first gearing and operatively connected to the camshaft via a second gearing; and hydraulic regulating means including a guide bush arranged within the housing and fluidly connected to the pressure compartments via fluid-carrying passageway means for alternately supplying a pressure fluid to the pressure compartments to effect an axial displacement of the piston and thereby a positional adjustment of the control bushing, said fluid-carrying passageway means including first and second axially spaced ring channels or distribution spaces which are fluidly connected to each other by a first transfer zone, and a third distribution space connected to one of the first and second ring channels by a second transfer zone, with the first and second transfer zones arranged in angularly offset disposition so that the piston is held in the starting position during starting phase of the internal combustion engine, said first and second ring channels and said first and second transfer zones being formed in the guide bush.

2. The apparatus of claim 1 wherein the piston is of circular configuration.

3. The apparatus of claim 1 wherein the control bushing is connected in form-fitting manner with the camshaft.

4. The apparatus of claim 1 wherein each of the transfer zones is formed by several neighboring bores.

5. The apparatus of claim 1 wherein the distribution spaces are each configured as annular grooves.

6. The apparatus of claim 1 wherein the hydraulic regulating means includes a sleeve-like seal carrier mounted on the camshaft said guide bush having one end received in fluid-tight manner by the seal carrier, said distribution spaces being defined by the seal carrier and the guide bush, with the transfer zones being formed by bores.

7. The apparatus of claim 1 wherein the transition zones are offset at an angle of 120°, with one transfer zone always coinciding with a vertical axis of the apparatus.

8. The apparatus of claim 6, and further comprising a sealing ring for effectively sealing the pressure compartments, said sealing ring being secured on the guide bush and exhibiting a sealing lip which bears upon an inside surface of the control bushing which is in concentric disposition to the guide bush.

9. The apparatus of claim 6 wherein the seal carrier and the guide bush are of rotationally symmetrical configuration and secured in place relative to each other.

10. The apparatus of claim 9, and further comprising an anti-rotation device secured between the guide bush and the seal carrier for preventing a rotation of the guide bush relative to the seal carrier and effecting a placement of the guide bush only in a particular angular position relative to the seal carrier.

11. The apparatus of claim 10, and further comprising a toothed sleeve securely fixed on the camshaft, said the anti-rotation device including a ring securely mounted upon the toothed sleeve and formed with an axial extension for engagement in a bore of the seal carrier.

12. The apparatus of claim 11 wherein the ring is formed through a non-cutting deep-drawing process.

* * * * *